US008408010B2

(12) United States Patent
Garry et al.

(10) Patent No.: US 8,408,010 B2
(45) Date of Patent: Apr. 2, 2013

(54) COMBUSTOR WALL APPARATUS WITH PARTS JOINED BY MECHANICAL FASTENERS

(75) Inventors: Ian Murray Garry, Leicestershire (GB); Michael Lawrence Carlisle, Derby (GB)

(73) Assignee: Rolls-Royce PLC, London (GB)

( * ) Notice: Subject to any disclaimer, the term of this patent is extended or adjusted under 35 U.S.C. 154(b) by 1027 days.

(21) Appl. No.: 12/365,181

(22) Filed: Feb. 4, 2009

(65) Prior Publication Data

US 2009/0229273 A1 Sep. 17, 2009

(30) Foreign Application Priority Data

Feb. 11, 2008 (GB) ..... 0802379.8

(51) Int. Cl.
*F02C 7/20* (2006.01)

(52) U.S. Cl. ..... 60/796; 60/798

(58) Field of Classification Search ..... 60/796, 60/798, 800, 752, 39.37, 754–760; 285/424, 285/183
See application file for complete search history.

(56) References Cited

U.S. PATENT DOCUMENTS

| | | | | | |
|---|---|---|---|---|---|
| 1,205,132 | A | * | 11/1916 | Black et al. | 285/148.24 |
| 1,451,887 | A | * | 4/1923 | Novak | 285/123.16 |
| 2,011,329 | A | | 8/1935 | Wayer | |
| 2,509,503 | A | * | 5/1950 | Huyton | 248/49 |
| 2,617,255 | A | | 11/1952 | Niehus | |
| 2,858,851 | A | | 11/1958 | Holl | |
| 2,916,878 | A | | 12/1959 | Wirt | |
| 2,933,895 | A | | 4/1960 | Cheeseman | |
| 3,011,507 | A | | 12/1961 | Hansen | |
| 3,295,280 | A | | 1/1967 | Kettner | |
| 3,429,683 | A | | 2/1969 | Jehn | |
| 3,533,430 | A | | 10/1970 | Fredd | |
| 3,678,959 | A | | 7/1972 | Liposky | |
| 3,774,638 | A | | 11/1973 | Kriett | |
| 4,030,875 | A | | 6/1977 | Grondahl et al. | |
| 4,095,418 | A | | 6/1978 | Mansson et al. | |
| 4,203,458 | A | | 5/1980 | Barrett et al. | |
| 4,284,103 | A | | 8/1981 | Pemberton | |
| 4,315,405 | A | | 2/1982 | Pidcock et al. | |
| 4,343,601 | A | | 8/1982 | Thorson | |
| 4,454,892 | A | | 6/1984 | Chadshay | |
| 4,628,694 | A | * | 12/1986 | Kelm et al. | 60/752 |
| 4,652,476 | A | | 3/1987 | Kromey | |
| 4,793,591 | A | | 12/1988 | Decker et al. | |
| 5,000,005 | A | | 3/1991 | Kwan et al. | |
| 5,046,702 | A | | 9/1991 | Miyazawa et al. | |
| 5,050,385 | A | | 9/1991 | Hirose et al. | |
| 5,069,034 | A | * | 12/1991 | Jourdain et al. | 60/766 |
| 5,137,586 | A | | 8/1992 | Klink | |

(Continued)

FOREIGN PATENT DOCUMENTS

| | | |
|---|---|---|
| DE | 10136196 A1 | 2/2003 |
| EP | 1734136 | 12/2006 |

(Continued)

*Primary Examiner* — Ehud Gartenberg
*Assistant Examiner* — Vikansha Dwivedi
(74) *Attorney, Agent, or Firm* — McCormick, Paulding & Huber LLP

(57) ABSTRACT

A lower cost combustor is formed from a series of sheets of metal that are secured by mechanical fasteners. An increase in diameter of the combustor is achieved through the provision of securing rings to which the sheets of metal are secured.

10 Claims, 2 Drawing Sheets

U.S. PATENT DOCUMENTS

| | | | | |
|---|---|---|---|---|
| 5,285,809 | A | 2/1994 | Shimoguri | |
| 5,331,816 | A | 7/1994 | Able et al. | |
| 5,341,769 | A | 8/1994 | Ueno et al. | |
| 5,405,261 | A | 4/1995 | Scraggs et al. | |
| 5,449,422 | A | 9/1995 | Pflanz et al. | |
| 5,553,455 | A | 9/1996 | Craig et al. | |
| 5,577,379 | A | 11/1996 | Johnson | |
| 5,701,732 | A | 12/1997 | Nesbitt et al. | |
| 5,704,208 | A * | 1/1998 | Brewer et al. | 60/766 |
| 5,709,919 | A | 1/1998 | Kranzmann et al. | |
| 5,782,294 | A | 7/1998 | Froemming et al. | |
| 5,799,491 | A | 9/1998 | Bell et al. | |
| 5,957,067 | A | 9/1999 | Dobbeling et al. | |
| 6,050,081 | A | 4/2000 | Jansen et al. | |
| 6,174,389 | B1 | 1/2001 | Mann | |
| 6,182,442 | B1 | 2/2001 | Schmidt et al. | |
| 6,199,371 | B1 | 3/2001 | Brewer et al. | |
| 6,351,949 | B1 | 3/2002 | Rice et al. | |
| 6,438,963 | B1 | 8/2002 | Traver et al. | |
| 6,470,685 | B2 | 10/2002 | Pidcock et al. | |
| 6,702,338 | B2 * | 3/2004 | Vanasse | 285/407 |
| 6,770,325 | B2 | 8/2004 | Troczynski et al. | |
| 6,901,757 | B2 | 6/2005 | Gerendas | |
| 6,931,831 | B2 | 8/2005 | Jansen | |
| 7,024,862 | B2 | 4/2006 | Miyake et al. | |
| 7,281,529 | B2 | 10/2007 | Lew et al. | |
| 7,658,201 | B2 | 2/2010 | Salomon | |
| 2002/0026784 | A1 | 3/2002 | Nakamoto | |
| 2002/0184892 | A1 | 12/2002 | Calvez et al. | |
| 2003/0056516 | A1 | 3/2003 | Hadder | |
| 2003/0079475 | A1 | 5/2003 | Schmahl et al. | |
| 2004/0110041 | A1 | 6/2004 | Merrill et al. | |
| 2004/0118127 | A1 | 6/2004 | Mitchell et al. | |
| 2005/0034399 | A1 | 2/2005 | Pidcock et al. | |
| 2005/0238859 | A1 | 10/2005 | Uchimaru et al. | |
| 2006/0070655 | A1 | 4/2006 | Tebby | |
| 2006/0242914 | A1 | 11/2006 | Stephansky et al. | |
| 2007/0028592 | A1 | 2/2007 | Grote et al. | |
| 2007/0028620 | A1 | 2/2007 | McMasters et al. | |
| 2007/0107710 | A1 | 5/2007 | De Sousa et al. | |
| 2007/0234730 | A1 | 10/2007 | Markham et al. | |
| 2007/0246149 | A1 | 10/2007 | Millard et al. | |
| 2007/0289307 | A1 | 12/2007 | Grote et al. | |
| 2008/0099465 | A1 | 5/2008 | Myers et al. | |

FOREIGN PATENT DOCUMENTS

| | | | |
|---|---|---|---|
| EP | 1734136 | A2 | 12/2006 |
| EP | 1741891 | A1 | 1/2007 |
| GB | 1503921 | | 3/1978 |
| GB | 2148949 | A | 10/1984 |
| GB | 2353589 | A | 2/2001 |
| GB | 2361304 | A | 10/2001 |
| JP | 8021687 | A | 7/1994 |

* cited by examiner

COMBUSTOR WALL APPARATUS WITH PARTS JOINED BY MECHANICAL FASTENERS

CROSS REFERENCE TO RELATED APPLICATION

This application is entitled to the benefit of British Patent Application No. GB 0802379.8, filed on Feb. 11, 2008.

FIELD OF THE INVENTION

This invention relates to combustors and in particular combustors for lower cost and possibly disposable turbine engines.

BACKGROUND OF THE INVENTION

Combustors for turbine engines are typically made using cast heads welded to either rolled or expanded sheet walls. Alternative walls are constructed from forgings machined to provide the desired construction. Either way produces a high integrity component that is unfortunately too expensive to be sensible option for short-life, single operation turbine engines.

SUMMARY OF THE INVENTION

It is an object of the present invention to provide a cheaper combustor for a gas turbine engine.

According to a first aspect of the invention there is provided a combustor for a turbine engine, the combustor having an outer wall extending about a combustor axis and at least one ring shaped support, wherein the outer wall is formed from a plurality of adjacent axial lengths of wall, each axial length being separated from a neighbouring axial length by one of the ring shaped supports, wherein an end of each adjacent axial lengths is secured to the ring shaped support by a plurality of mechanical fasteners.

Preferably, the plurality of mechanical fasteners are tabs and apertures.

Each axial length of wall may be formed with tabs, which engage apertures on the ring shaped support.

Preferably, the neighbouring axial lengths are stepped radially from each other.

Each axial length may be formed from a sheet of material with mechanical fastener means along its longitudinal edges, which engage such that the sheet forms a tube.

The mechanical fastening means along the longitudinal edges may be tabs engaging apertures.

DETAILED DESCRIPTION OF THE PREFERRED EMBODIMENTS

Figure 1:
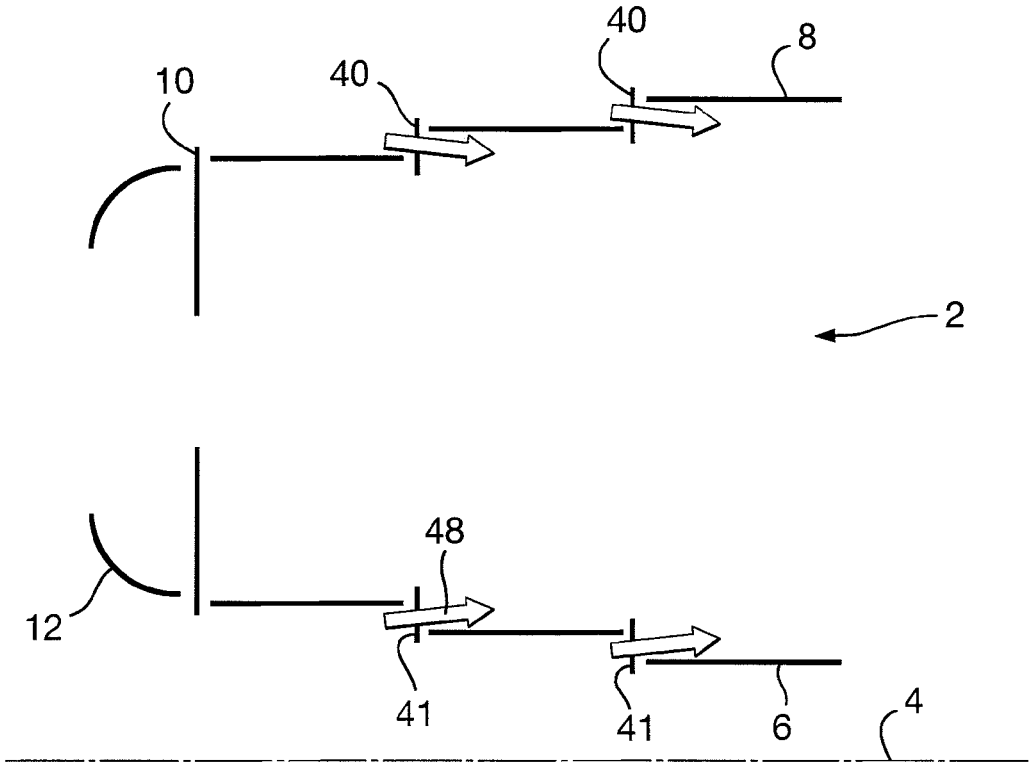
FIG. 1 depicts a cross-section of a portion of a turbine combustor formed in accordance with the invention.

FIG. 1 depicts the top half of an annular combustor 2 manufactured in accordance with the invention with the combustor extending about an engine and combustor centre line 4. The annular combustor has a radially inner wall 6 and a radially outer wall 8, both of which extend about the axis 4. The combustion volume lies between the inner and outer walls.

The walls 6,8 are joined at their upstream end to a combustor head component 10 to which an upstream cowl 12 may be provided if required by the engine design. The combustor head 10 has apertures 14 through which a fuel injector head (not shown) can be inserted. The injector supplies a spray of fuel to the combustor volume that is ignited by an igniter (not shown).

Figure 2:
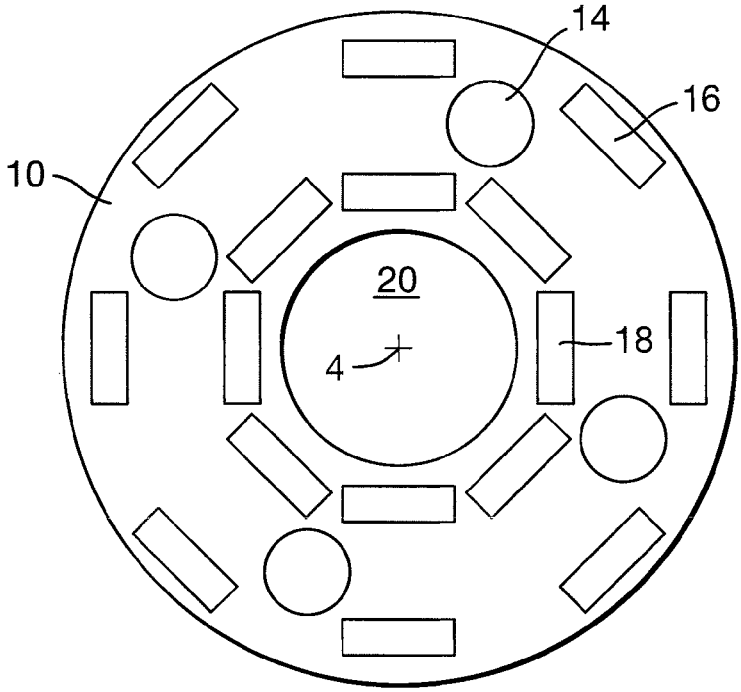
FIG. 2 depicts a combustor head formed in accordance with the invention.

The combustor head 10, as shown in FIG. 2, is generally disc shaped and formed of a sheet material. The sheet material may be cut or punched to the desired shape using a mechanical tool. Preferably, the sheet material is laser cut to provide both its exterior shape and cut to provide its internal apertures 14, 16, 18 and 20.

As mentioned above some of the internal apertures 14 are used to provide access to present the fuel injector to the combustion volume. Other apertures 16, 18 are used to attach the inner and outer walls of the combustor to the combustor head, as will be explained in more detail a bit later.

The final aperture permits passage of a shaft or the like mechanically linking an upstream compressor and a downstream turbine, the downstream turbine using the products of combustion to power the upstream compressor.

The combustor head is preferably formed of a high-temperature resistant alloy such as a nickel superalloy. For cost reasons, it may be desirable to form the head from a lower temperature resistant material, which is provided with a thermal barrier coating to improve its temperature resistance.

Figure 3:
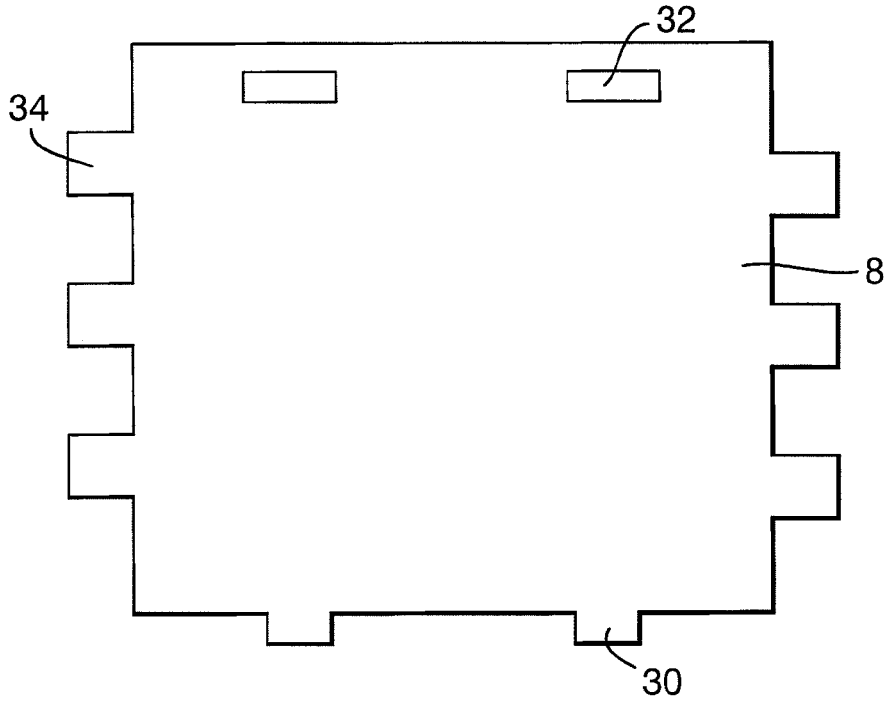
FIG. 3 depicts a combustor wall formed in accordance with the invention.
Figure 4:
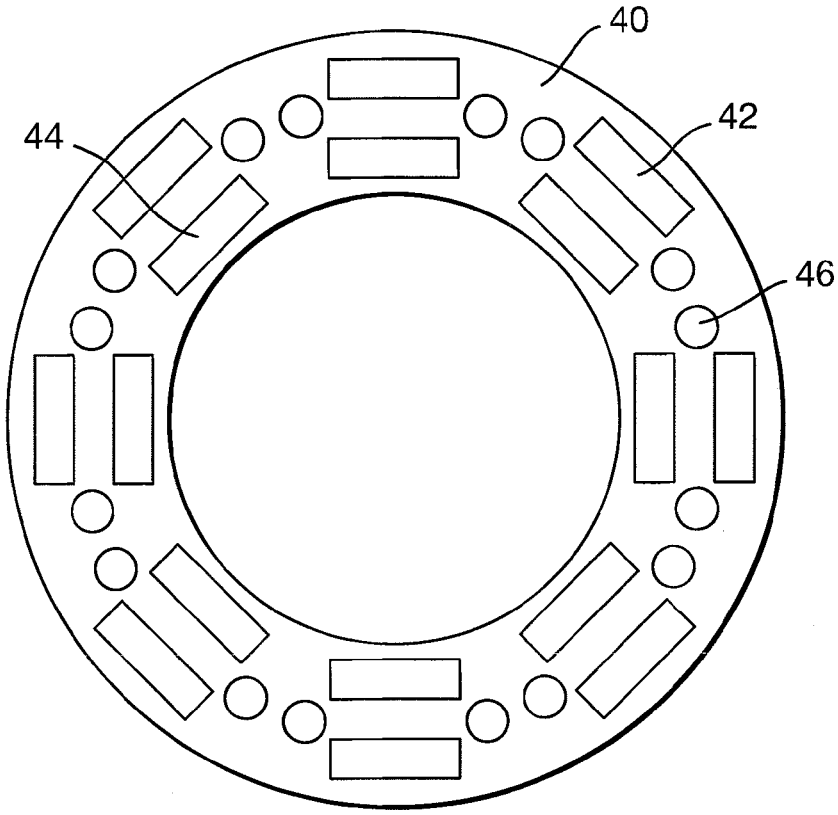
FIG. 4 depicts an intermediate cooling ring in accordance with the invention.

The combustor walls are formed of a sheet material as depicted in FIG. 3. The sheets have tabs 30 and recesses 32 that allow them to be joined to adjacent sheets thereby creating a wall that extends about the whole circumference of the combustor. Beneficially, this method permits relatively large combustors to be formed from multiple sheets. Where the combustor is smaller, or manufacturing capability permits, it is possible to use a single sheet bent around the circumference. The mechanical fasteners located on one edge of the sheet fitting into the complementary mechanical fastener on the opposing edge of the sheet. In a slightly alternative arrangement, the sheets may be replaced by pipes with the correct diameter and cut to a desired length. Such pipes may be stock items, e.g. of the petrochemical or other industries and are therefore relatively cheap.

Tabs 34 are located on the axially upper end of the sheet and these are positioned in locations corresponding to the apertures 16 or 18 depending on whether the sheet is to form the radially inner or outer wall of the combustor. To attach the wall to the combustor head the sheet or sheets are bent and secured together to form a cylinder. The tabs are inserted through their corresponding apertures and bent or twisted to secure the cylinder to the head. Where a pipe is used to form the wall rather than a sheet the pipe is formed with a series of tabs or cut to form a series of tabs, which are used to secure the pipe to the combustor head in the same way that the cylinder is secured.

In many combustor arrangements it is desirable to provide outward steps at regular intervals along its length. The modular approach of manufacturing the combustor makes this extremely simple. The combustor is provided with supporting rings 40 formed, like the combustor head, of shaped sheet metal.

The support ring has a circumferentially extending array of apertures 44 for receiving tabs located on a sheet forming the portion of the combustor wall that is located upstream of the support ring 40. A second circumferentially extending array of apertures 42 are located on the support ring in a position which receives corresponding tabs on a sheet forming the portion of the combustor wall that is located downstream of the support ring 40. As the support ring enables a radially outward step in the combustor wall the second array of apertures is radially outside the first array.

An array of holes 46 permit a volume of air 48 to be supplied to the interior of the combustor for cooling or dilution purposes.

It will be appreciated that, for an axial combustor, two support rings 40, 41 are required for each radial step. The first support ring 40 is provided to the radially outer wall of the combustor, whilst the second support ring 41 is provided to the radially inner wall of the combustor. For turbo-annular or cylindrical combustion chambers it will be appreciated that it is possible to provide a single support ring per outward step.

Once the tabs of the wall 8 have been inserted through the appropriate apertures 16, 18 on the combustor head or the support ring 42, 44 it is possible to twist or bend the tab to secure the wall to the head or support ring. Any appropriate tab shape could be used. Appropriate tabs are known from EP1097309 and EP1259339. The teachings of both these patents are incorporated herein by reference.

Beneficially, the invention permits a robust combustor to be manufactured simply and cheaply from a number of cheaply and easily formed components. By securing of the components together using mechanical fasteners rather than welding the expensive welding operations are removed and inspection of the finished combustor for defects is simplified.

What is claimed is:

1. A combustor for a turbine engine, the combustor having:

an outer wall extending about a combustor axis, an inner wall coaxially arranged with the outer wall, and at least one ring shaped support;

wherein the ring shaped support extends in a generally radial direction and has, a radially inner array of apertures, the radially inner array extending circumferentially about the axis, and a radially outer array of apertures, the radially outer array extending circumferentially about the axis;

the outer wall being secured to the ring shaped support using tabs extending through the radially outer array of apertures, the inner wall being secured to the ring shaped support using tabs extending through the radially inner array of apertures.

2. A combustor according to claim 1, wherein each axial length is formed from a sheet of material with mechanical fastening means along its longitudinal edges which engage such that the sheet forms a tube.

3. A combustor according to claim 2, wherein the mechanical fastening means along the longitudinal edges are tabs engaging apertures.

4. A combustor according to claim 1, wherein each axial length is formed from a plurality of sheets of material which have mechanical fastener means along their axially extending edges which engage mechanical fastening means on an axially extending edge of an adjacent sheet such that the plurality of sheets form a tube.

5. A combustor according to claim 4, wherein the mechanical fastener means are tabs and the mechanical fastening means are apertures.

6. A combustor for a turbine engine, the combustor having:

an outer wall extending about a combustor axis, and at least one ring shaped support;

wherein the ring shaped support extends in a generally radial direction and has, a radially inner array of apertures, the radially inner array extending circumferentially about the axis, and a radially outer array of apertures, the radially outer array extending circumferentially about the axis;

the outer wall having two cylindrical portions, a first cylindrical portion being secured to a first side of the ring shapes support by a plurality of tabs extending through the radially inner array of apertures, and a second cylindrical portion being secured to a side of the ring shaped support opposite the first side by a plurality of tabs extending through the radially outer array of apertures.

7. A combustor for a turbine engine according to claim 6, wherein each cylindrical portion is formed from a sheet of material with mechanical fastening means along its longitudinal edges which engage to provide the cylindrical portion.

8. A combustor according to claim 7, wherein the mechanical fastening means along the longitudinal edges are tabs engaging apertures.

9. A combustor according to claim 6 which further comprises:

an inner wall extending about the combustor axis, and an inner-wall ring shaped support which extends in a generally radial direction and has a radially inner array of apertures, the radially inner array extending circumferentially about the axis, and a radially outer array of apertures, the radially outer array extending circumferentially about the axis;

the inner wall having two cylindrical portions, a first cylindrical portion being secured to a first side of the ring shapes support by a plurality of tabs extending through the radially inner array of apertures, and a second cylindrical portion being secured to a side of the ring shaped support opposite the first side by a plurality of tabs extending through the radially outer array of apertures.

10. A combustor according to claim 9, wherein a combustion volume in which fuel is combusted is defined between the outer wall and the inner wall.

* * * * *